United States Patent [19]

Stenlund

[11] Patent Number: 4,570,563

[45] Date of Patent: Feb. 18, 1986

[54] GROUNDING PROTECTIVE DEVICE FOR BOATS

[75] Inventor: Stig Stenlund, Saltsjöbaden, Sweden

[73] Assignee: Hypeco AB, Alvsjö , Sweden

[21] Appl. No.: 589,076

[22] PCT Filed: Jun. 8, 1983

[86] PCT No.: PCT/SE83/00235

§ 371 Date: Feb. 7, 1984

§ 102(e) Date: Feb. 7, 1984

[87] PCT Pub. No.: WO83/04400

PCT Pub. Date: Dec. 22, 1983

[30] Foreign Application Priority Data

Jun. 8, 1982 [SE] Sweden ..... 8203550

[51] Int. Cl.[4] ..... B63B 59/02

[52] U.S. Cl. ..... 114/140; 114/219; 114/39

[58] Field of Search ..... 114/127, 140, 213, 215, 114/219, 128–143; 440/56, 65; 244/110 C, 1 R, 121

[56] References Cited

U.S. PATENT DOCUMENTS

| | | | |
|---|---|---|---|
| 3,085,544 | 4/1963 | Hamlyn et al. | 440/56 |
| 3,462,960 | 8/1969 | Bruehl | 114/219 |
| 3,717,326 | 2/1973 | Leach et al. | 244/110 C X |

FOREIGN PATENT DOCUMENTS

| | | | |
|---|---|---|---|
| 626611 | 10/1961 | Italy . | |
| 21845 | of 1900 | United Kingdom | 114/141 |

*Primary Examiner*—Trygve M. Blix
*Assistant Examiner*—Edwin L. Swinehart
*Attorney, Agent, or Firm*—Holman & Stern

[57] ABSTRACT

Grounding protective device for sailing vessels and similar boats provided with a fin keel to eliminate to the greatest possible extent the impact effect on a boat when the keel touches ground and to give a long braking distance in order to prevent damage to the boat and the risk of injuries to crew members. A stay is provided in the central plane of the boat which extends from at least either of the end edges of the fin keel at their lower ends to a point so located, that between the point and the fin keel the stay extends at least as deep as any part of the boat.

8 Claims, 2 Drawing Figures

GROUNDING PROTECTIVE DEVICE FOR BOATS

CROSS REFERENCE TO RELATED APPLICATION(S)

This United States application stems from PCT International Application No. PCT/SE83/00235 filed June 8, 1983.

BACKGROUND OF THE INVENTION

1. Field of the Invention

This invention relates to a grounding protective device for sailing and similar boats provided with a fin keel.

2. Description of the Prior Art

Sailing vessels or sailing boats are in principle provided with a fixed keel, which may be designed in two different ways. One keel design comprises a continuous garboard plate, which extends from prow to stern and mostly is comprised in the hull proper. The second design relates to so-called fin keels, which consist of a garboard plate, which is attached in the central plane of the boat approximately below the center thereof, and secured in the hull generally by keel bolts. The first mentioned boat type is called long-keeled boats, and the boat rudder generally is attached to the trailing edge of the keel. When such a boat touches ground, the boat runs aground with its middle line against the ground, and the grounding mostly proceeds cautiously, so that there is only small or no damage at all to the boat. The sliding movement of the keel on the ground produces a relatively soft braking of the speed of the boat, whereby a heavy impact on the boat is avoided. The risk of injuries for the crew, therefore, is low.

BRIEF SUMMARY OF THE INVENTION

The present invention has the object to eliminate to the greatest possible extent the effect of the impact on a boat with a fin keel when the boat touches ground with the keel. It is essential that boat and crew are given a long braking distance in order to prevent damage to the boat and injuries to the crew. It is possible, within certain limits, to build boats, which are capable of withstanding running aground, but human beings cannot be reinforced and, therefore, the braking must proceed mildly and through a long distance. A further object of the invention is to eliminate damage to freely suspended rudders of fin-keel boats. In order to achieve the above objects, the invention is characterized in that in the central plane of the boat a stay is provided which extends from at least one of the end edges of the fin keel at the lower end to a point so located that between the point and the fin keel the stay extends at least as deep as any part of the boat. Fin-keel boats can be understood also to be boats similar to long-keel boats, which at some portion of the keel length, have an inclination which does not allow the boat to slide up on the ground.

BRIEF DESCRIPTION OF THE DRAWINGS

Two embodiments of the invention will now be described in the following detailed description, with reference to the accompanying drawings wherein.

DETAILED DESCRIPTION

Figure 1:
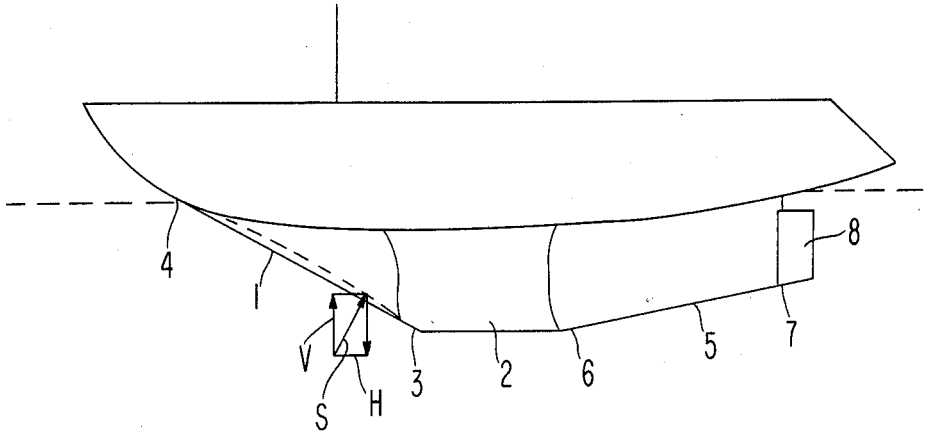
FIG. 1 is a schematic elevational side view of a first embodiment of the invention.

As appears from the figures, a sailing boat with fin keel is shown. The fin keel is presupposed to be rigidly secured in the lower surface of the hull. There exists also fin-keel boats, at which the keel can be retracted into the hull. Although the invention also can be applied to such a type of fin keel, it is hereinafter assumed that the fin keel is rigidly secured in the lower part of the hull along the middle line thereof.

Groundings occur most often in such a way, that the ground is located below the water surface. Accordingly, it is the leading edge of the fin keel which strikes the ground, and the remaining part of the hull passes over the ground. As the ground hereby causes the boat directly and immediately to stop at the place of contact, a strong impact force arises which is transferred to the area of attachment between the fin keel and hull. The fin keel generally is so rigid that it is not deformed, or is deformed very little. This implies that in the contact between ground and keel no substantial deformation work arises which could reduce the stress caused by the impact force in the area of attachment between the fin keel and hull. The amount of the impact force depends on the weight and speed of the boat. When the speed is not braked, and deformation work does not arise anywhere during the collision, then the stress to be taken up in the attachment between the fin keel and hull depends directly on the weight and speed of the boat. In order to limit the braking force on the boat to an amount suitable in view of boat and crew, the braking distance must be relatively long, i.e. of about the same length as the keel. Deformation, for example of the leading edge of the keel, therefore, is not a practically possible solution. Already at moderate speeds, the damages can be disastrous for the boat. It is more important, however, that the strong and generally unexpected impact upon grounding creates a dangerous situation for the crew whose members often are injured. These injuries are serious per se, but in addition difficulties arise due to the fact that simultaneously the maneuvering situation of the boat must be managed. Even if no catastrophic leakage has been caused, the attachment between keel and hull has been damaged to such a great extent, that the boat is unfit and must be taken up on land for repair. The damages which could possibly occur imply that the hull is smashed in the area where the keel is secured, due to the high torsional moment caused by the impact. Thus, in the area at the trailing edge of the keel compression occurs, and a tension force occurs in the area at the leading edge of the keel in the hull area. These forces are reversed by the present invention and remain reversed until the keel strikes the ground. The hull in the keel area can be deformed and, in addition, the keel bolts can break or be deformed permanently and must be replaced. It has happened that sailing boats with fin keels after having grounded at moderate speed have been regarded as substantially irreparably, i.e. incapable of continuing to sail. In other cases and at milder groundings, considerable damages yet can be caused, although the hull is not destroyed so that leakage occurs. The keel bolts can be deformed so that the fin assumes an oblique attitude relative to the central plane of the boat, which produces deteriorated sailing of the boat. It is to be mentioned, that fin-keel boats as they are at present manufactured almost all have the disadvantage that grounding often causes serious damages. An extreme racing sailing boat always must be taken up as soon as the slightest ground contact with the fin keel has occurred. The greatest objective in the construction of fin-keel boats today should be to attach the fin keel to the hull so that even with slight ground contact no catastrophe occurs and, of course, in cases of sudden brakings no serious risks are involved for the crew.

A further problem with fin-keel boats is that the rudder is suspended freely from the keel and, thus, a certain distance aft of the trailing edge of the fin keel. It happens quite often that at mild groundings the boat bounces with the keel over the ground in such a way, that the ground will be located between the trailing edge of the fin keel and the rudder, whereby the rudder will be exposed to the next impact. A rudder in no way can withstand such an impact, and therefore the rudder axle will break or will be irreparably damaged. The aforesaid applies to entirely freely suspended rudders as well as to rudders provided with a supporting yoke. The present invention, in a second embodiment, prevents to a great extent damage to the rudder when the boat with a fin keel bounces over ground.

The invention becomes apparent from the drawing which shows a stay 1 positioned in the central plane of the boat extending from the leading edge 3 of the fin keel 2 at the lowermost point thereof to the leading edge 4 of the stem. When this stay 1, for exammple, is a steel wire, it will, due to its elasticity, be deflected aside if it contacts ground located below the draught of the hull but above the lower edge of the fin keel. During a certain period of the grounding the stay can assume a position shown in FIG. 1 by a dashed line. The impact forces thereby has two components, viz. a horizontal one H and a vertical one V. The vertical component tends to lift the boat over the ground while the horizontal component H brakes the speed of the boat against the ground. It is understood that the ideal case would be the one where the vertical force, i.e. the lifting force on the boat also does the entire braking of the boat. In such a case the impact force is zero at the moment the keel meets the ground. When the fin, in spite of the fact that braking work is carried out, meets the ground, the stay acts as a reinforcing stay and reduces the stresses on the fin attachment.

The stay, as mentioned, can be a steel wire, but other materials can also be utilized. The essential feature is that braking work is provided by the stay, and the ground is prevented from meeting directly the leading edge of the fin keel. It also is important that the stay is formed so that the smallest possible water resistance is brought about by the stay. The stay, therefore, is to be placed in the central plane of the boat and must be streamlined in cross-section in parallel with the water line of the boat. Due to the inclination of the stay of about 25° to the horizontal plane, its section in the flow direction is extended and, thus, more favorable than a vertical stay. In a second embodiment, also shown in FIG. 1, a stay 5 is inserted between the trailing edge 6 of the fin keel and a point located at the lower edge of the rudder at the pivot center 7 thereof. When the boat bounces over ground, the ground is prevented from coming between the trailing edge of the fin keel and the leading edge of the rudder 8, and the boat continues to side so that the ground cannot strike the leading edge of the rudder. The stay 5 also protects a propeller located between the fin keel and rudder from being damaged when the boat bounces over a stone at grounding.

Figure 2:
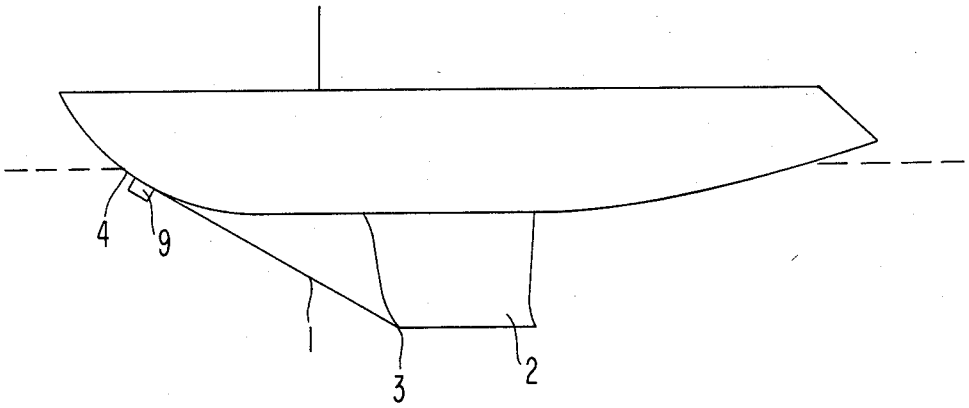
FIG. 2 is a view similar to FIG. 1 of another embodiment of the invention.

The stays 1 and 5 should be dimensioned so that when being extended plastically they never produce forces so high that the mountings of the stays are overloaded and thereby cause hull damage. In FIG. 2 a variation is shown schematically, which consists of a stay 1 that is designed superstrong, but the mounting in the leading edge of the hull is made by means of a force-limiting member 9, for example a built-in shear rod, which is attached between the stay 1 and the leading edge 4 of the stem, and which breaks before the stresses on the leading edge of the stem and/or the leading edge 3 of the fin are so high that damages may arise. It is also understood that the member 9 can be formed so that it extends to absorb tensile load, which implies that the stay can be designed rigid and the braking force is absorbed by means of the member 9 instead of, or as a complement to, the stay 1 in the event of a collision thereagainst. The member 9 may for this purpose be a spring or a deformable, exchangeable, or replaceable, body.

It is understood that the stays 1 and 5, within the scope of what has been described above, can be designed in different ways and also can be given different tension. It is advantageous to be able to attach the stay 1 as far as possible ahead, so that the inclination relative to the water line is minimal. The invention, however, is not restricted in this respect, but, depending on the form of the stem line and the form and location of the fin keel, two points are selected for attaching the stay which provide the best possible capacity for absorbing the forces of a collision. It also may be suitable to design the stay mountings detachable, so that in racing sailing boats, for example, the stays are attached only during transport to and from the place of racing, but during the race the stays are removed. It cannot be avoided that the stays yield a certain water resistance, but it should be possible to reduce the resistance to such an extent that the usefulness of the stays in the event of grounding outweighs any disadvantages due to water resistance.

I claim:

1. A device for protecting sailing and similar vessels having a fixed fin keel when running aground or hitting objects, comprising:

an elongated stay attached at one end to the leading edge of the keel at the lowermost end thereof and extending therefrom in a longitudinal direction and attached at the other end to the stem edge of the hull of the vessel;

said stay being positioned with respect to the vessel so that any point on said stay between said ends is at least as deep as any part of the vessel between said ends of the stay lying in the same substantially vertical plane as said point; and said stay being elastically or plastically extendable a predetermined extent to absorb shock forces due to impact of objects thereon sufficiently to prevent damage to the keel, hull and attachments at said ends of said stay.

2. A device as claimed in claim 1 and further comprising:

a load-limiting member operatively disposed between at least one of said ends of said stay and the respective position on the vessel and operable to break at a predetermined load imposed thereon by said stay to prevent damage to the attachments at the ends of said stay.

3. A device as claimed in claim 2 wherein:

said load-limiting member comprises means for absorbing tensile stress.

4. A device as claimed in claim 1, wherein said stay comprises a steel wire having sufficient tensile strength and elasticity to absorb said shock forces.

5. A device as claimed in claim 3, wherein said means comprises a spring.

6. A device as claimed in claim 3, wherein said means comprises a deformable exchangeable body.

7. A device as claimed in claim 1, wherein the cross-section of the stay parallel to the water line is stream-line-shaped.

8. A device as claimed in claim 1, wherein said stay is secured detachably at said ends to the vessel.

* * * * *